US009093738B2

(12) United States Patent
Hung

(10) Patent No.: US 9,093,738 B2
(45) Date of Patent: Jul. 28, 2015

(54) ANTENNA

(71) Applicant: ACCTON TECHNOLOGY CORPORATION, Hsinchu (TW)

(72) Inventor: Ching-Fa Hung, Hsinchu (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 208 days.

(21) Appl. No.: 13/927,893

(22) Filed: Jun. 26, 2013

(65) Prior Publication Data

US 2014/0078002 A1 Mar. 20, 2014

(30) Foreign Application Priority Data

Sep. 19, 2012 (TW) ..... 101134323 A

(51) Int. Cl.

| | |
|---|---|
| ***H01Q 1/38*** | (2006.01) |
| ***H01Q 9/04*** | (2006.01) |
| ***H01Q 1/36*** | (2006.01) |
| ***H01Q 9/42*** | (2006.01) |

(52) U.S. Cl.

CPC ..... *H01Q 9/0407* (2013.01); *H01Q 1/36* (2013.01); *H01Q 9/42* (2013.01)

(58) Field of Classification Search

CPC ..... H01Q 1/36; H01Q 9/0407; H01Q 9/42
USPC ..... 373/700 MS, 829, 846
See application file for complete search history.

(56) References Cited

U.S. PATENT DOCUMENTS

| | | | | |
|---|---|---|---|---|
| 7,352,326 | B2 * | 4/2008 | Korva et al. | 343/700 MS |
| 7,358,903 | B1 * | 4/2008 | Su et al. | 343/700 MS |
| 7,646,342 | B2 * | 1/2010 | Huang et al. | 343/700 MS |
| 7,667,662 | B2 * | 2/2010 | Chiang | 343/846 |
| 7,903,035 | B2 * | 3/2011 | Mikkola et al. | 343/702 |
| 7,986,274 | B2 * | 7/2011 | Yang et al. | 343/700 MS |
| 8,779,985 | B2 * | 7/2014 | Oh | 343/700 MS |

FOREIGN PATENT DOCUMENTS

| | | |
|---|---|---|
| CN | 1377102 | 10/2002 |
| KR | 20110109383 A | 10/2011 |

* cited by examiner

*Primary Examiner* — Tho G Phan
(74) *Attorney, Agent, or Firm* — Ming Chow; Sinorica, LLC

(57) ABSTRACT

An antenna includes an oscillating member and a grounding member arranged toward each other. The oscillating member includes a main body and a first extending section. The first extending section is projected from a first end of the main body toward the grounding member. The grounding member includes a main body, a second extending section, a third extending section, a fourth extending section and a grounding section. The second extending section is projected from a third end of the main body toward the oscillating member; the third extending section is projected from a fourth end of the main body toward the oscillating member; the grounding section is projected from the main body toward the oscillating member. The second extending section is the only one to electrically connect the oscillating member and the grounding member. The grounding section has a grounding point as a ground of the antenna.

9 Claims, 6 Drawing Sheets test 2D Pattern @2400.0MHz

| | H | V | H+V |
|---|---|---|---|
| Max Gain | -11.54 | 3.57 | 3.58 |

test 2D Pattern @2410.0MHz

| | H | V | H+V |
|---|---|---|---|
| Max Gain | -11.21 | 3.69 | 3.73 |

test 2D Pattern @2420.0MHz

| | H | V | H+V |
|---|---|---|---|
| Max Gain | -10.31 | 3.83 | 3.87 |

test 2D Pattern @2430.0MHz

| | H | V | H+V |
|---|---|---|---|
| Max Gain | -9.8 | 3.83 | 3.89 |

test 2D Pattern @2440.0MHz

| | H | V | H+V |
|---|---|---|---|
| Max Gain | -9.13 | 3.88 | 3.92 |

test 2D Pattern @2450.0MHz

| | H | V | H+V |
|---|---|---|---|
| Max Gain | -8.72 | 3.87 | 3.94 |

test 2D Pattern @2460.0MHz

| | H | V | H+V |
|---|---|---|---|
| Max Gain | -8.51 | 3.79 | 3.84 |

test 2D Pattern @2470.0MHz

| | H | V | H+V |
|---|---|---|---|
| Max Gain | -8.47 | 3.77 | 3.87 |

test 2D Pattern @2480.0MHz

| | H | V | H+V |
|---|---|---|---|
| Max Gain | -8.02 | 3.8 | 3.83 |

test 2D Pattern @2490.0MHz

| | H | V | H+V |
|---|---|---|---|
| Max Gain | -7.89 | 3.84 | 3.89 |

test 2D Pattern @2500.0MHz

| | H | V | H+V |
|---|---|---|---|
| Max Gain | -7.72 | 3.69 | 3.75 |

ANTENNA

The current application claims a foreign priority to the patent application of Taiwan No. 101134323 filed on Sep. 19, 2012.

BACKGROUND OF THE INVENTION

1. Field of the Invention

The present invention relates generally to an antenna, and more particularly to a structure of an antenna.

2. Description of the Related Art

Since technology of wireless telecommunication is advancing, there are a lot of electronic devices transmit and receive wireless signals through antennas, and 2.4 GHz is the most widely used radio bands.

Planar inverted F (PIFA) antenna and inverted F antenna (IFA) are the most common antennas applied for the wireless telecommunication via 2.4 GHz radio bands. However, PIFA and IFA are directional antennas, which mean that signals can only be transmitted and received well along a particular direction. In other words, such antennas as PIFA and IFA have dead zones, and there should be room for improvement.

SUMMARY OF THE INVENTION

The primary objective of the present invention is to provide an antenna, which may work like an omnidirectional antenna.

According to the objective of the present invention, the present invention provides an antenna, comprising an oscillating member and a grounding member, wherein the grounding member and the oscillating member are arranged toward each other. The oscillating member includes a main body and a first extending section, wherein the main body has a first end, a second end on the opposite side of the first end, and a feed point for receiving input signal; the first extending section is projected from the first end of the main body toward the grounding member. The grounding member includes a main body, a second extending section, a third extending section, and a grounding section, wherein the main body has a third end and a fourth end, wherein the third end is arranged as same direction as the first end, and the fourth end is arranged as same direction as the third end; the second extending section is projected from the third end of the main body toward the oscillating member, wherein the second extending section contacts the oscillating member to electrically connect with the oscillating member and the grounding member; the third extending section is projected from the fourth end of the main body toward the oscillating member, wherein the second extending section is located between the first extending section and the third extending section; the grounding section is projected from the main body toward the oscillating member, and the grounding section is located between the second extending section and the third extending section; besides, the grounding section has a grounding point as a ground of the antenna.

In an embodiment, the antenna satisfies the following conditions:

1) A=3/5B to 7/5B
2) C=1/3A to1/5A
3) D=2/3E
4) B=1/3W to 1/5W
5) F≤G
6) H≤I
7) G>I
8) C>I wherein A is a length of the main body of the grounding member;

B is a length of the main body of the oscillating member;

C is a length of the third extending section of the grounding member;

D is a length of the grounding section of the grounding member;

E is a length of the first extending section of the oscillating member;

F is a width of the main body of the oscillating member;

G is a width of the first extending section of the oscillating member;

H is a width of the main body of the grounding member;

I is a width of the third extending section of the grounding member; and

W is a wavelength of the signals produced by the antenna.

In an embodiment, a resistance of the feed point is 50 ohms.

Herewith the antenna works like an omnidirectional antenna.

DETAILED DESCRIPTION OF THE INVENTION

The detailed description and technical contents of the present invention will be explained with reference to the accompanying drawings. However, the drawings are illustrative only but not used to limit the present invention.

Figure 1:
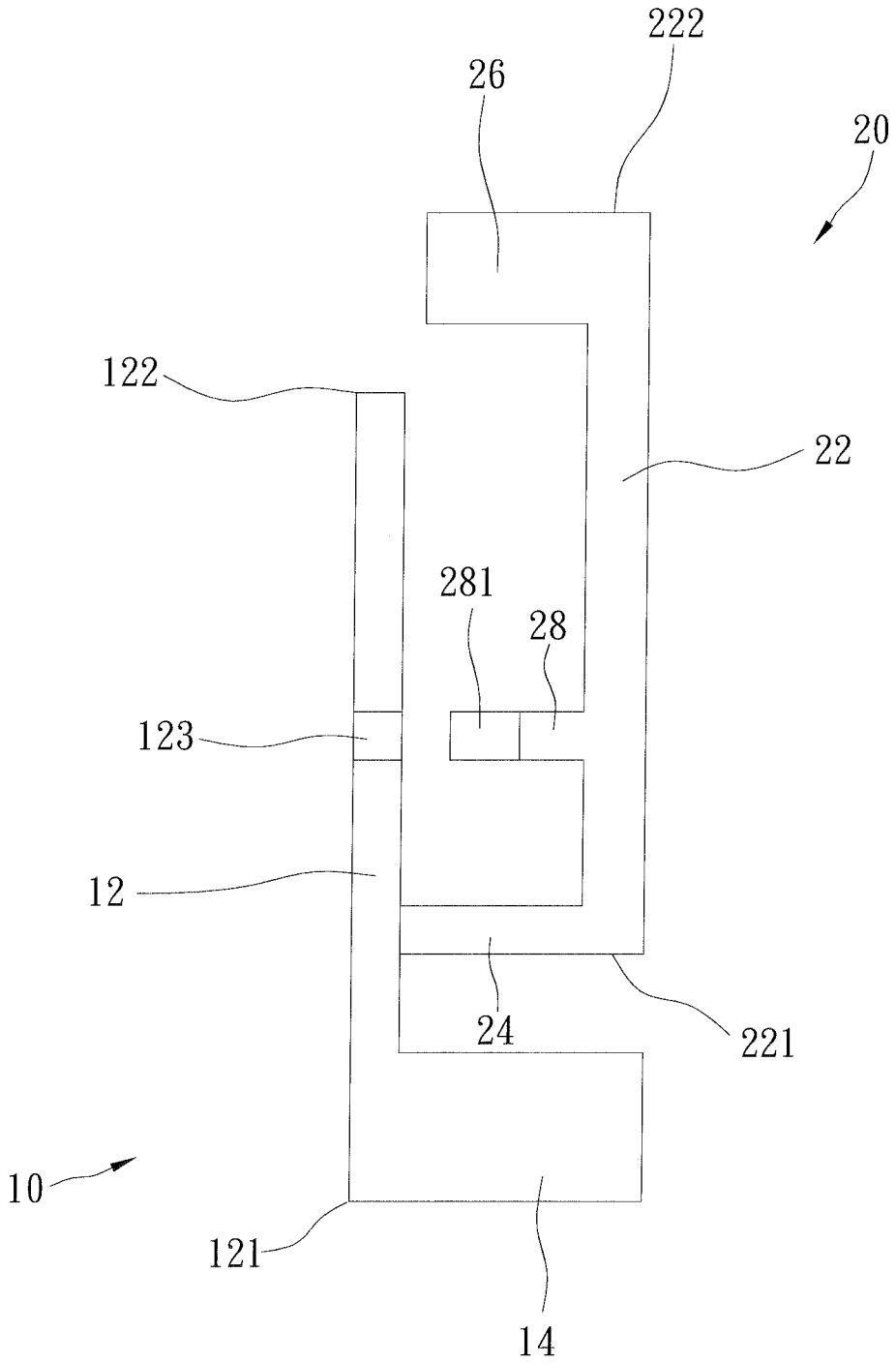
FIG. 1 is a structural diagram of the antenna of a preferred embodiment of the present invention.

FIG. 1 shows an antenna of the preferred embodiment of the present invention, which includes an oscillating member 10 and a grounding member 20. The oscillating member 10 and the grounding member 20 are arranged toward each other.

The oscillating member 10 includes a main body 12 and a first extending section 14. The main body 12 has a first end 121 and a second end 122 on the opposite side of the first end 121. The main body 12 further has a feed point 123 for receiving signals from outside the antenna. In an embodiment, a resistance of the feed point 123 is 50 ohms (Ω), which makes the antenna to transmit and receive wireless signals through the impedance matching of wireless telecommunication. The first extending section 14 is projected from the first end 121 of the main body 12 toward the grounding member 20. However, the first extending section 14 does not contact the grounding member 20.

The grounding member 20 has a main body 22, a second extending section 24, a third extending section 26, and a grounding section 28. The main body 22 has a third end 221 which is arranged toward the same direction as the first end 121, and a fourth end 222 which is arranged toward the same direction as the second end 122. The second extending section 24 is projected from the third end 221 toward the oscillating member 10. The second extending section 24 contacts the main body 12 of the oscillating member 10 to electrically connect to the oscillating member 10 and the grounding member 20. The third extending section 26 is projected from the fourth end 222 toward the oscillating member 10 without contacting the oscillating member 10. The second extending section 24 is located between the first extending section 14 and the third extending section 26. The grounding section 28 is on the main body 22 of the grounding member 20 and projected from the main body 22 toward the oscillating member 10 without contacting the oscillating member 10. The grounding section 28 is located between the second extending section 24 and the third extending section 26. Besides, the grounding section 28 has a grounding terminal 281 as a ground of the antenna.

The structure of the antenna of the embodiment is different from PIFA and IFA, and the antenna of the embodiment may transmit and receive signals in all directions.

Figure 2:
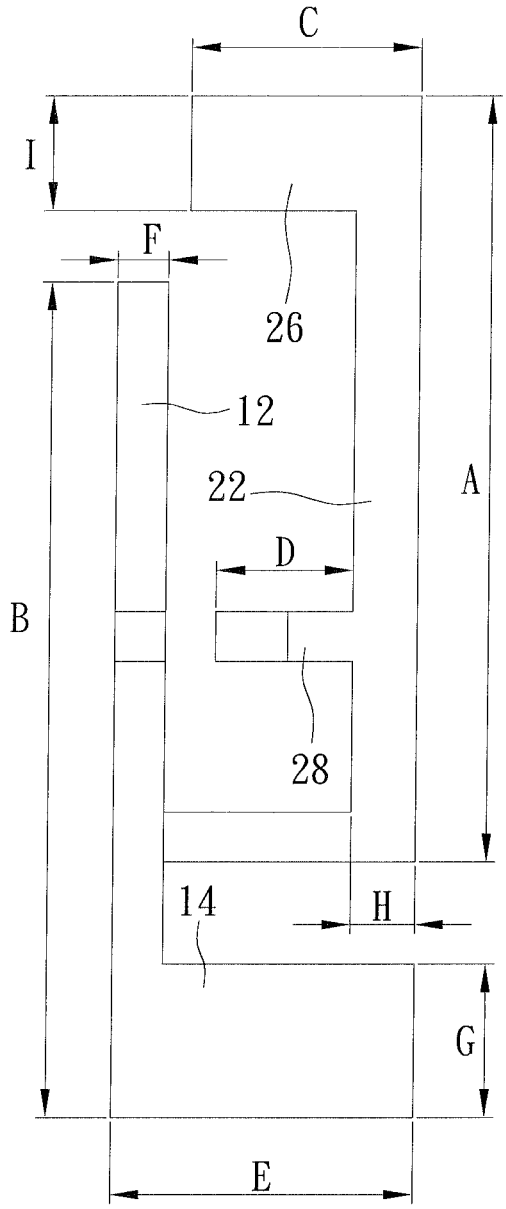
FIG. 2 is another structural diagram of the antenna of the preferred embodiment of the present invention.
Figure 3A:
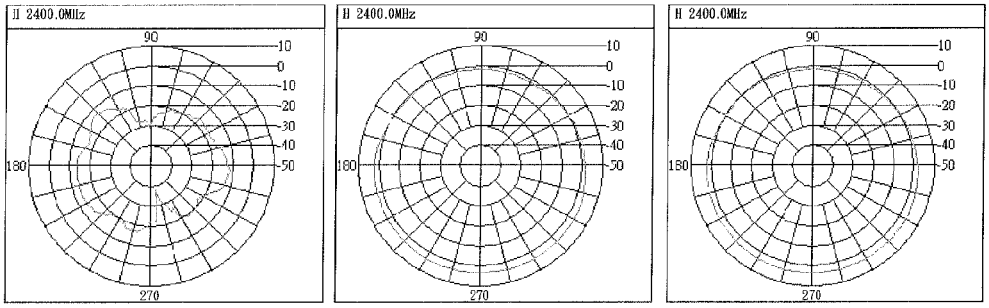
FIG. 3A to FIG. 3K are the field pattern diagrams of the antenna of the preferred embodiment of the present invention.
Figure 3B:
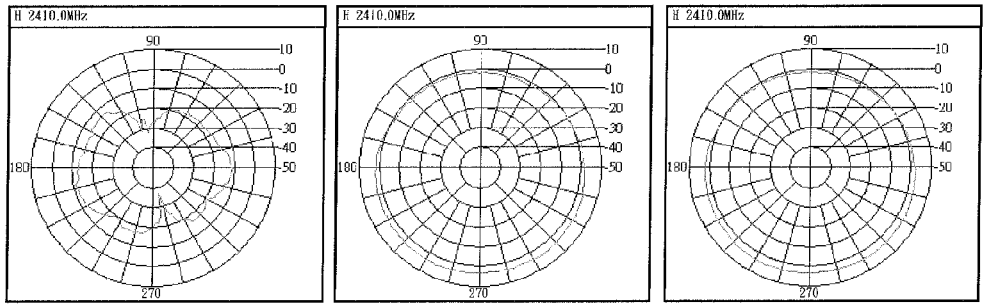
Figure 3C:
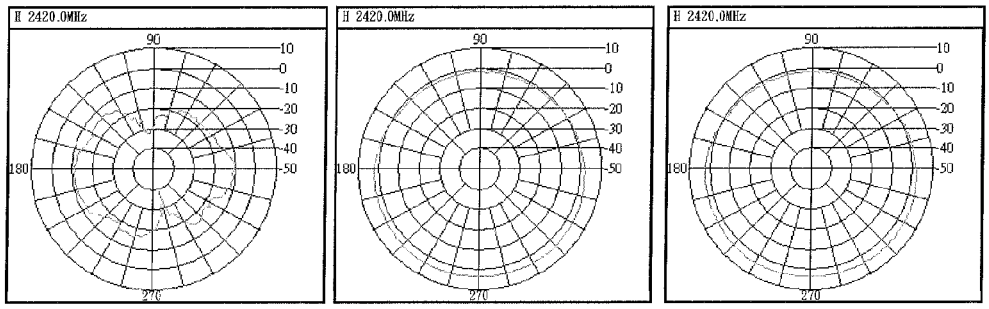
Figure 3D:
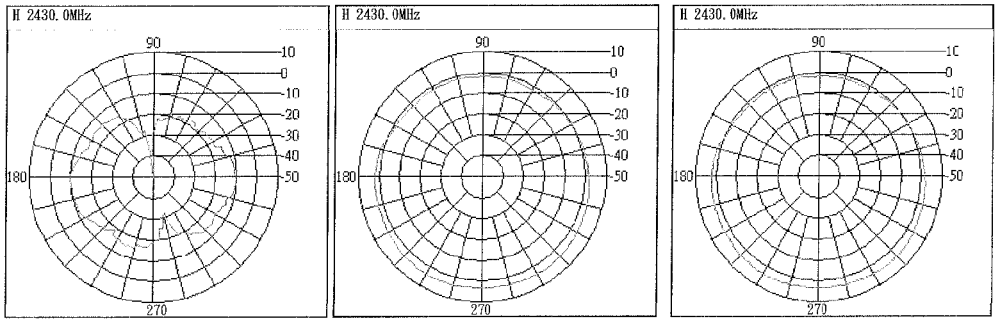
Figure 3E:
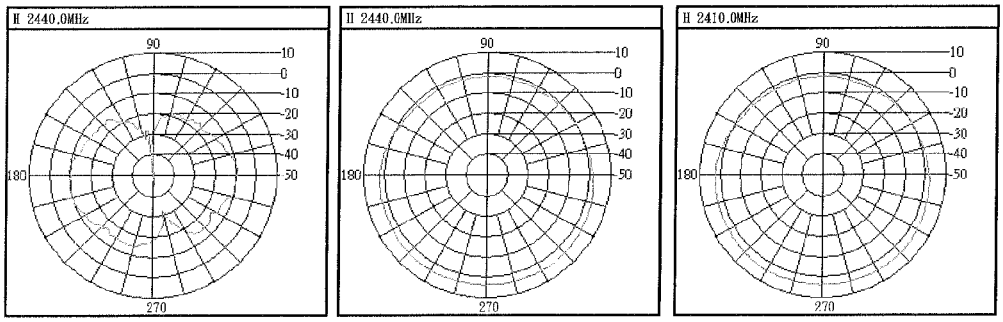
Figure 3F:
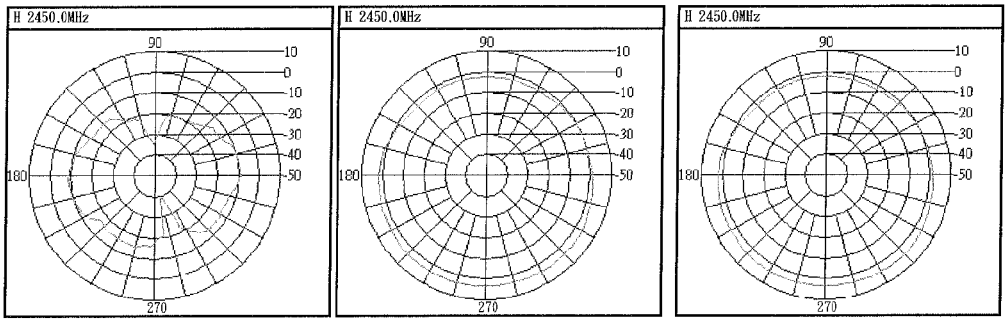
Figure 3G:
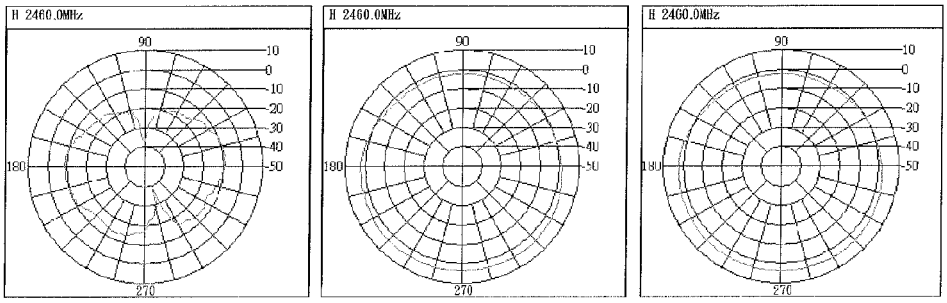
Figure 3H:
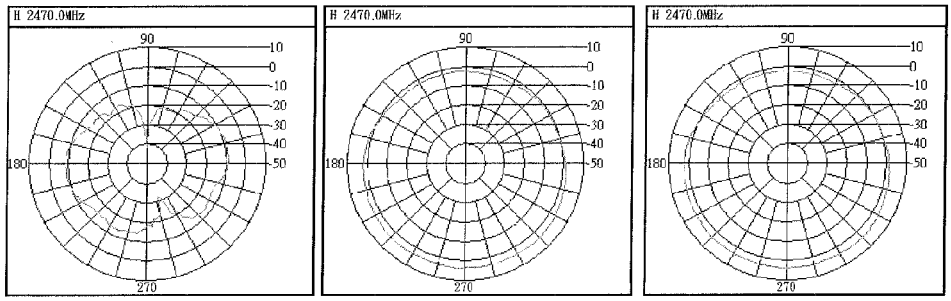
Figure 3I:
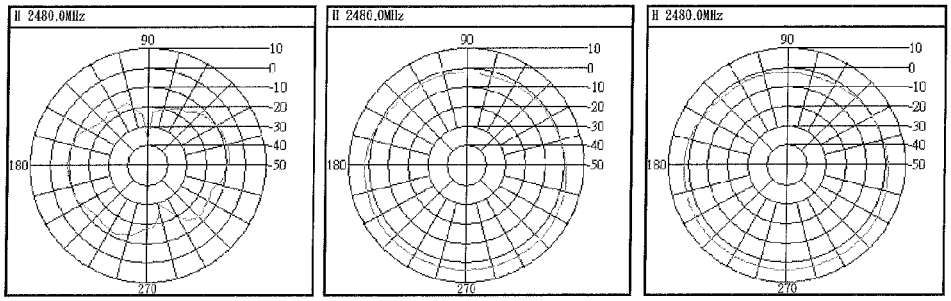
Figure 3J:
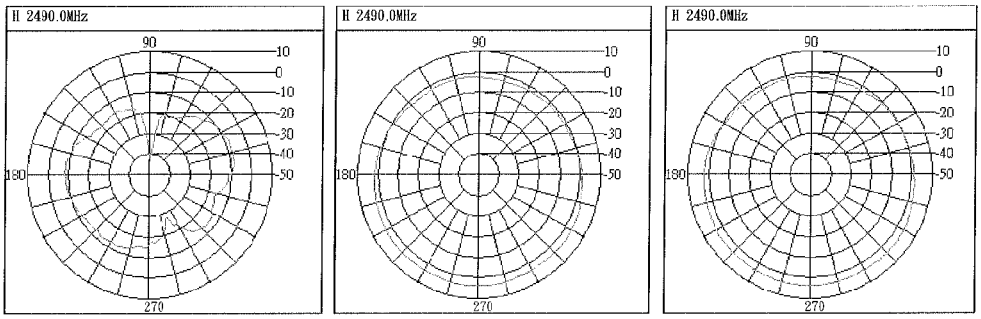
Figure 3K:
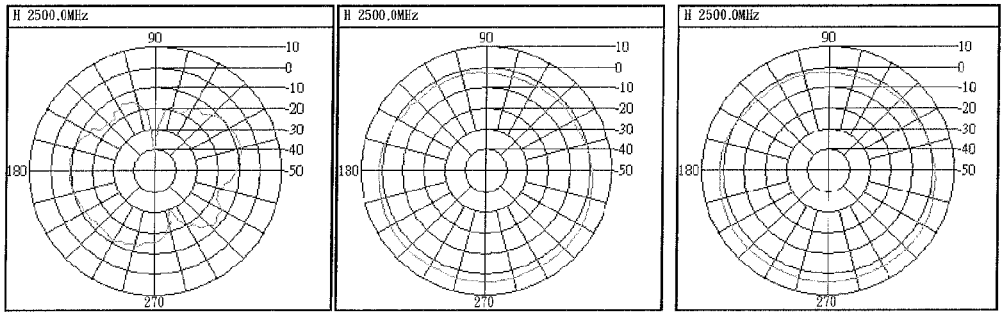

As shown in FIG. 2, the antenna of the embodiment satisfies the following conditions:

1) A=3/5B to 7/5B
2) C=1/3A to 1/5A
3) D=2/3E
4) B=1/3W to 1/5W
5) F≤G
6) H≤I
7) G>I
8) C>I wherein A is a length of the main body 22 of the grounding member 20;

B is a length of the main body 12 of the oscillating member 10;

C is a length of the third extending section 26 of the grounding member 20;

D is a length of the grounding section 28 of the grounding member 20;

E is a length of the first extending section 14 of the oscillating member 10;

F is a width of the main body 12 of the oscillating member 10;

G is a width of the first extending section 14 of the oscillating member 10;

H is a width of the main body 22 of the ground device 20;

I is a width of the third extending section 26 of the grounding member 20; and W is a wavelength of the signals produced by the antenna.

The preferable characters of the antenna of the embodiment are:

1) A=B
2) C=1/4A
3) D=2/3E
4) B=1/4W
5) F≤G
6) H≤G
7) G>I
8) C=2I

As shown in FIGs. from FIG. 3A to FIG. 3K, while the antenna of the embodiment receives the signal via the feed point 123 and generates a signal with a frequency range between 2.4 GHz and 2.5 GHz (2.4 GHz radio bands) accordingly, it may generates a round (or close to round) signal coverage area. Therefore, these FIGs may prove that the antenna of the embodiment may work as an omnidirectional antenna.

The description above is a few preferred embodiments of the present invention, and the equivalence of the present invention is still in the scope of claim construction of the present invention.

What is claimed is:

1. An antenna, comprising an oscillating member and a grounding member, wherein the grounding member and the oscillating member are arranged toward each other, the oscillating member comprising:

a main body having a first end, a second end on the opposite side of the first end, and a feed point for receiving input signal; and a first extending section projected from the first end of the main body toward the grounding member;

the grounding member comprising:

a main body having a third end and a fourth end, the third end arranged to same direction as the first end, and the fourth end arranged to same direction as the second end;

a second extending section projected from the third end of the main body toward the oscillating member, the second extending section contacting the oscillating member to electrically connect with the oscillating member and the grounding member;

a third extending section projected from the fourth end of the main body toward the oscillating member, the second extending section located between the first extending section and the third extending section; and a grounding section projected from the main body toward the oscillating member, the grounding section located between the second extending section and the third extending section, and the grounding section having a grounding point as a ground of the antenna.

2. The antenna as defined in claim 1, wherein the antenna satisfies the following conditions:

A=3/5B to 7/5B;
C=1/3A to 1/5A;
B=1/3W to 1/5W; and
C>I;

wherein

A is a length of the main body of the grounding member;

B is a length of the main body of the oscillating member;

C is a length of the third extending section of the grounding member;

I is a width of the third extending section of the grounding member; and

W is a wavelength of signal produced by the antenna.

3. The antenna as defined in claim 2, wherein the antenna further satisfies the following conditions:

A=B;
C=1/4A;
B=1/4W; and
C=2I.

4. The antenna as defined in claim 3, wherein the antenna further satisfies the following conditions:

D=2/3E;
F≤G;
H≤I; and
G>I;

wherein

D is a length of the grounding section of the grounding member;

E is a length of the first extending section of the oscillating member;

F is a width of the main body of the oscillating member;

G is a width of the first extending section of the oscillating member; and

H is a width of the main body of the grounding member.

5. The antenna as defined in claim 1, wherein a resistance of the feed point is 50 ohms.

6. An antenna, comprising an oscillating member and a grounding member, wherein the grounding member and the oscillating member are arranged toward each other, the oscillating member comprising:

a main body having a first end, a second end on the opposite side of the first end, and a feed point for receiving input signal; and a first extending section projected from the first end of the main body toward the grounding member;

the grounding member comprising:

a main body having a third end and a fourth end, the third end arranged to same direction as the first end, and the fourth end arranged to same direction as the second end;

a second extending section projected from the third end of the main body toward the oscillating member, the second extending section contacting the oscillating member to electrically connect with the oscillating member and the grounding member;

a third extending section projected from the fourth end of the main body toward the oscillating member, the second extending section located between the first extending section and the third extending section; and a grounding section projected from the main body toward the oscillating member, the grounding section located between the second extending section and the third extending section, and the grounding section having a grounding point as a ground of the antenna;

wherein the antenna further satisfies the following conditions:

$A=3/5B$ to $7/5B$;

$C=1/3A$ to $1/5A$;

$B=1/3W$ to $1/5W$;

$C>I$;

$D=2/3E$;

$F\leq G$;

$H\leq I$; and $G>I$;

wherein

A is a length of the main body of the grounding member;

B is a length of the main body of the oscillating member;

C is a length of the third extending section of the grounding member;

D is a length of the grounding section of the grounding member;

E is a length of the first extending section of the oscillating member;

F is a width of the main body of the oscillating member;

G is a width of the first extending section of the oscillating member;

H is a width of the main body of the grounding member;

I is a width of the third extending section of the grounding member; and

W is a wavelength of signal produced by the antenna.

7. The antenna as defined in claim 6, wherein a resistance of the feed point is 50 ohms

8. An antenna, comprising an oscillating member and a grounding member, wherein the grounding member and the oscillating member are arranged toward each other, the oscillating member comprising:

a main body having a first end, a second end on the opposite side of the first end, and a feed point for receiving input signal; and a first extending section projected from the first end of the main body toward the grounding member;

the grounding member comprising:

a main body having a third end and a fourth end, the third end arranged to same direction as the first end, and the fourth end arranged to same direction as the second end;

a second extending section projected from the third end of the main body toward the oscillating member, the second extending section contacting the oscillating member to electrically connect with the oscillating member and the grounding member;

a third extending section projected from the fourth end of the main body toward the oscillating member, the second extending section located between the first extending section and the third extending section; and a grounding section projected from the main body toward the oscillating member, the grounding section located between the second extending section and the third extending section, and the grounding section having a grounding point as a ground of the antenna;

wherein the antenna further satisfies the following conditions:

$A=B$;

$C=1/4A$;

$B=1/4W$;

$C=2I$;

$D=2/3E$;

$F\leq G$;

$H\leq I$; and $G>I$;

wherein

A is a length of the main body of the grounding member;

B is a length of the main body of the oscillating member;

C is a length of the third extending section of the grounding member;

D is a length of the grounding section of the grounding member;

E is a length of the first extending section of the oscillating member;

F is a width of the main body of the oscillating member;

G is a width of the first extending section of the oscillating member;

H is a width of the main body of the grounding member;

I is a width of the third extending section of the grounding member; and

W is a wavelength of signals produced by the antenna.

9. The antenna as defined in claim 8, wherein a resistance of the feed point is 50 ohms.

* * * * *